US011422506B2

(12) United States Patent
Bayat et al.

(10) Patent No.: US 11,422,506 B2
(45) Date of Patent: Aug. 23, 2022

(54) RESONATOR FOR A TIMEPIECE COMPRISING TWO BALANCES ARRANGED TO OSCILLATE IN THE SAME PLANE

(71) Applicant: ASSOCIATION SUISSE POUR LA RECHERCHE HORLOGERE (ASRH), Neuchâtel (CH)

(72) Inventors: Dara Bayat, Neuchâtel (CH); Yves Pétremand, Yverdon-les-Bains (CH); Ivar Kjelberg, Yverdon-les-Bains (CH)

(73) Assignee: ASSOCIATION SUISSE POUR LA RECHERCHE HORLOGERE (ASRH), Neuchâtel (CH)

( * ) Notice: Subject to any disclaimer, the term of this patent is extended or adjusted under 35 U.S.C. 154(b) by 705 days.

(21) Appl. No.: 16/469,935

(22) PCT Filed: Nov. 17, 2017

(86) PCT No.: PCT/IB2017/057199
§ 371 (c)(1),
(2) Date: Jun. 14, 2019

(87) PCT Pub. No.: WO2018/109583
PCT Pub. Date: Jun. 21, 2018

(65) Prior Publication Data

US 2020/0081401 A1 Mar. 12, 2020

(30) Foreign Application Priority Data

Dec. 16, 2016 (EP) ..... 16204580

(51) Int. Cl.
*G04B 17/06* (2006.01)

(52) U.S. Cl.
CPC ..... *G04B 17/063* (2013.01)

(58) Field of Classification Search
CPC ..... G04B 17/06; G04B 17/063; G04B 17/066
See application file for complete search history.

(56) References Cited

U.S. PATENT DOCUMENTS 3,520,127 A 7/1970 Meyer
9,207,641 B2 12/2015 Henein et al.
(Continued)

FOREIGN PATENT DOCUMENTS

CH 700747 10/2010
CH 709 291 8/2015
(Continued)

OTHER PUBLICATIONS

Definition—Strap dictionary.com May 4, 2022.*
International Search Report, PCT/IB2017/057199, dated Apr. 3, 2018.

*Primary Examiner* — Sean Kayes
(74) *Attorney, Agent, or Firm* — Nixon & Vanderhye

(57) ABSTRACT

The resonator for a timepiece includes a support structure permitting mounting the resonator in a timepiece, a first and a second balance arranged to oscillate in the same plane, at least one first and second elastic element respectively connecting the first and second balances to the support structure, the configuration of the elastic elements determining two parallel elastic pivoting axes for the two balances, and the elastic elements forming a resilient element angularly returning each of the balances towards an inoperative position. The resonator further includes a strap coupling the first and the second balance. The points joining the strap to the first and the second balance respectively are located in the same plane parallel to the plane of oscillation of the balances. When the balances are in their inoperative position, these joining points are symmetrical with respect to a center of symmetry midway between the geometrical pivoting axes.

20 Claims, 2 Drawing Sheets

(56) References Cited

U.S. PATENT DOCUMENTS

| | | | | |
|---|---|---|---|---|
| 9,354,609 | B2 * | 5/2016 | Born | G04B 15/02 |
| 9,477,205 | B2 | 10/2016 | Born et al. | |
| 2015/0063082 | A1 * | 3/2015 | Stranczl | G04B 15/06 368/127 |
| 2015/0131413 | A1 * | 5/2015 | Helfer | G04C 3/047 368/80 |
| 2015/0234354 | A1 | 8/2015 | Henein et al. | |
| 2016/0179058 | A1 | 6/2016 | Born et al. | |
| 2016/0223989 | A1 * | 8/2016 | Winkler | G04B 17/06 |
| 2017/0038730 | A1 * | 2/2017 | Winkler | G04B 17/06 |

FOREIGN PATENT DOCUMENTS

| | | |
|---|---|---|
| CH | 710691 | 8/2016 |
| EP | 2141555 | 1/2010 |
| EP | 2365403 | 9/2011 |
| EP | 2998800 | 3/2016 |
| EP | 3 035 127 | 6/2016 |
| FR | 1 539 670 | 9/1968 |
| WO | 2016/124436 | 8/2016 |

* cited by examiner

RESONATOR FOR A TIMEPIECE COMPRISING TWO BALANCES ARRANGED TO OSCILLATE IN THE SAME PLANE

FIELD OF THE INVENTION

The present invention relates to a resonator for a timepiece comprising a support structure intended to permit mounting of the resonator in a timepiece, two balances arranged to oscillate in the same plane, and a plurality of elastic elements arranged to connect the two balances to the support structure, the configuration of the plurality of elastic elements determining two parallel elastic pivoting axes for the two balances, and the plurality of elastic elements also forming resilient means arranged to angularly return each of the two balances towards an inoperative position.

PRIOR ART

Known mechanical watches usually use a sprung balance as a regulating member. This sprung balance is composed of three main parts: a balance in the form of a momentum wheel, a spindle which carries the balance and is terminated by two pivots permitting mounting of the balance in a timepiece frame, and finally a spiral spring which produces a return torque proportional to the size of the angle between the balance and its equilibrium position. As is well known, the sprung balance has been the quasi exclusive time base for mechanical watches for more than 300 years.

The use of a sprung balance as a time base offers the possibility of having watches which are robust and prove to have chronometric precision of the order of 15 seconds per day. It may thus be said that the sprung balance is a reliable and precise resonator. It remains the case that the precision of quartz watches is still greater than that of mechanical watches fitted with a sprung balance. This difference in precision can be attributed in part to the fact that a quartz tuning-fork has a quality factor considerably higher than that of a sprung balance.

The amplitude of the oscillations of a sprung balance is considerable. It conventionally varies between 180° and 315° depending on the degree of winding of the mainspring and according to whether the watch is closer to being horizontal or vertical. Under these conditions, the two bearings in which the spindle of the balance turns are highly stressed, which causes the dissipation of a fraction of the energy of the balance by friction. It will be understood that this friction contributes to a lowering of the quality factor of the sprung balance. Great strides have been made in providing balance bearings having optimised tribological properties. It remains the case that the negative effect of the friction on the quality factor has not yet been overcome.

With the aim of overcoming the problems just described, it has been proposed that the pivoting means of the balances be replaced by a flexible pivot. Patent document CH 709 291 A2, in particular, describes a resonator for a timepiece comprising a support element intended to permit mounting of the resonator in a timepiece, a balance in the form of a momentum wheel, and finally two elastic strips which connect the support element to the balance while crossing each other. The configuration of the two elastic strips is selected so as to define a geometrical pivoting axis concentric with the balance. Furthermore, the two strips are arranged to exert a return torque on the balance. With this construction, when the resonator oscillates, the two strips deform, acting simultaneously as a spiral spring and flexible pivot. It will be understood from the preceding statements that the solution proposed in this prior art document makes it possible to overcome one of the main causes of friction, since it removes the bearings of the balance and replaces them with a flexible pivot. According to document CH 709 291 A2, the proposed oscillator has a quality factor about 10 times higher than that of a sprung balance.

However, the above-mentioned resonator presents certain disadvantages. In fact, according to this document, the amplitude of the oscillations of the balance is typically 20°. Under these conditions, the effect of a possible lack of colinearity between, on the one hand, the angular momentum of the balance and, on the other hand, its geometrical pivoting axis cannot simply be cancelled out by the rotation. Moreover, there is a risk that a balance with a flexible pivot like that just described will be more sensitive to shocks than a sprung balance. In order to solve these last two problems, patent document EP 3 035 127 A1 proposes coupling two resonators, each having a flexible pivot, so as to produce a form of tuning fork. According to this proposal, the coupling between the two resonators is provided by mobile connection element to which the elastic strips of the two resonators are fixed by one end. The other end of each pair of strips is connected to one of the two balances as previously. It will be understood that according to this second, prior art document, the connection element carries the two balances while itself being elastically fixed to a support element rigidly mounted in the timepiece. With such an arrangement, the geometrical pivoting axes of the two balances each occupy a position which is fixed with respect to the connection element while being mobile collectively relative to the frame of the timepiece.

As indicated by the title of document EP 3 035 127 A1, the oscillator which it describes is in the form of a tuning fork. In this regard, it is known that an advantage linked to the symmetry of tuning forks is that it favours some well defined oscillation modes having a high quality factor. Among these oscillation modes, the two most fundamental modes are the symmetrical mode and the anti-symmetrical mode. With respect to horology applications, the anti-symmetrical mode (the prongs of the tuning fork move in opposing directions at one time) is the most advantageous by reason of its lower sensitivity to external phenomena; in particular to shocks. With a tuning fork intended for a horology application it is thus important that the symmetrical oscillation mode (the prongs of the tuning fork move in the same direction at one time) is always effectively damped. In this context, document EP 3 035 127 A1 teaches coupling of the oscillations of the two balances by using a connection element elastically suspended on a fixed element. One particular feature of the anti-symmetrical resonance mode is that the mass centre of the system remains at rest, the forces acting on the connection element of the tuning fork cancel each other out. Under these conditions, in order to favour the anti-symmetrical resonance mode it is necessary to adjust the suspension of the connection element so that the vibrations of this element are strongly damped while ensuring that the connection element remains free to transmit to the second balance the excitation pulses received on the first balance. In view of the preceding statements, it may be feared that satisfactory adjustment of the suspension of the connection element will require a high level of dexterity.

BRIEF DESCRIPTION OF THE INVENTION

One aim of the present invention is to provide a resonator with a high quality factor and comprising two mechanically coupled balances, the coupling between the balances being designed to favour the anti-symmetrical oscillation mode. The invention achieves this aim by providing a resonator as claimed in the appended claim 1.

In the present patent application, the expression "support structure" does not necessarily designate one single support piece. In fact, in accordance with the invention, the support structure can comprise e.g. two distinct support elements, one of the support elements serving to mount the first balance and the other support element serving to mount the second balance.

BRIEF DESCRIPTION OF THE FIGURES

Other features and advantages of the present invention will become clear upon reading the following description, given solely by way of non-limiting example, and given with reference to the attached drawings in which.

DETAILED DESCRIPTION OF EMBODIMENTS

Figure 1:
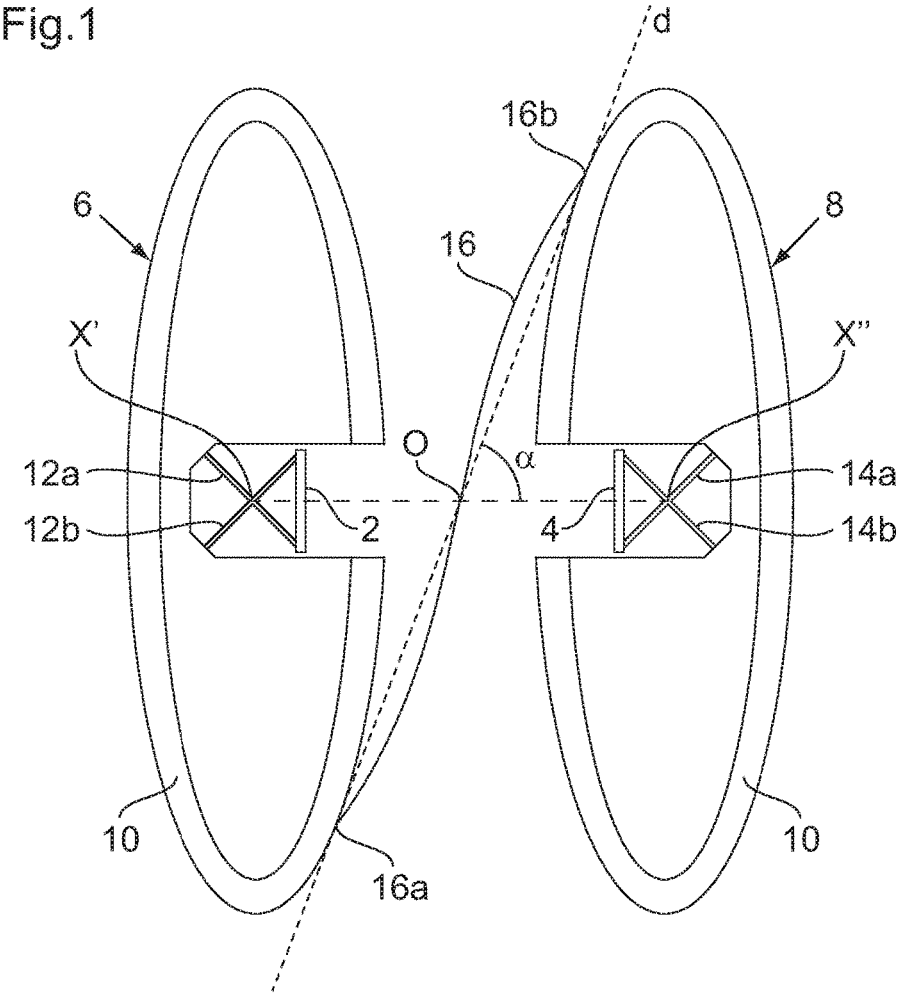
FIG. 1 is a plan view from above of a resonator for a timepiece in accordance with a first particular embodiment of the invention.

FIG. 1 is a plan view from above of a resonator for a timepiece in accordance with one particular embodiment of the invention. In accordance with the invention, the illustrated resonator comprises a support structure intended to permit mounting thereof on a frame (not shown) of a mechanical watch. In the present example, the support structure is formed by two bars respectively referenced 2 and 4. The resonator also comprises two balances generally referenced 6 and 8 which, in the illustrated example, are each generally in the form of an ellipse with a large central notch. When the balances are in their inoperative position as illustrated, the openings of the two notches face each other. It can also be seen that the two bars 2, 4 of the support structure are each arranged inside one of the notches. Each balance also comprises a rim 10 provided to endow it with greater inertia. The rim extends along the periphery of the balance. The first and the second balance preferably have the same mass and the same dimensions so that it is easy to cause them to oscillate at the same frequency.

In accordance with the invention, the balances are connected to the support structure by a plurality of elastic elements. More specifically, in the illustrated embodiment, each balance 6, 8 is connected to one of the two bars 2, 4 by a pair of elastic strips (referenced respectively 12*a*, 12*b* and 14*a*, 14*b*). As shown in the figure, one of the ends of each strip is attached to the balance by the bottom of the notch, while the other end is fixedly attached to the bar located in the same notch so that each pair of elastic strips is arranged inside the notch of the balance to which it is attached. It can also be seen that the two elastic strips of the same pair cross each other so as to form an X which extends in the plane of the balance inside the notch. A person skilled in the art will understand from the preceding statements that the configuration of the pair of strips connecting one of the balances to the support structure determines a geometrical elastic pivoting axis X', X" for this balance. The geometrical pivoting axis is perpendicular to the plane of the balance and it passes via the point of intersection of the two strips of the X. This point of intersection moves very slightly during the movement of the balances. For reasons which will become clear hereinunder, the X formed by the elastic strips is preferably positioned in the notch so that the intersection of the geometrical pivoting axis with the plane of the balance coincides with the centre of mass balance.

FIG. 1 also shows that the two elastic strips 12*a*, 12*b* or 14*a*, 14*b* which form the X have their joining point half way between their two ends. Simulations actually show that the configuration, according to which the two strips of the X-shaped structure intersect in the middle, makes it possible to obtain an intrinsic rotation without friction about the geometrical pivoting axis. Furthermore, an X-shaped flexible pivot of this type has the advantageous characteristic of producing a return torque proportional to the size of the angle between the balance and its equilibrium position, and does so in one direction as in the other. It will also be noted that the expression "intrinsic rotation" used above designates a rotation which minimises the displacement of the pivoting axis.

It will be assumed for the remainder of this description that the height of the strips corresponds to the extension thereof perpendicular to the plane of the balance, whereas their thickness corresponds to their extension in the plane of the balance, perpendicular to their length. The thickness of the strips is preferably reduced so as to provide the elastic strips with sufficient flexibility in the plane of the balance. The height of the strips is determined so as the provide them with sufficient rigidity to contain the oscillations of the balance in the same specific plane. The two pairs of strips are preferably produced from identical material. Furthermore, as shown in the figures, the two X-shaped flexible pivots preferably have identical dimensions so that the first and the second balance have the same fundamental resonance frequency when they have the same mass and the same moment of inertia.

Figure 2A:
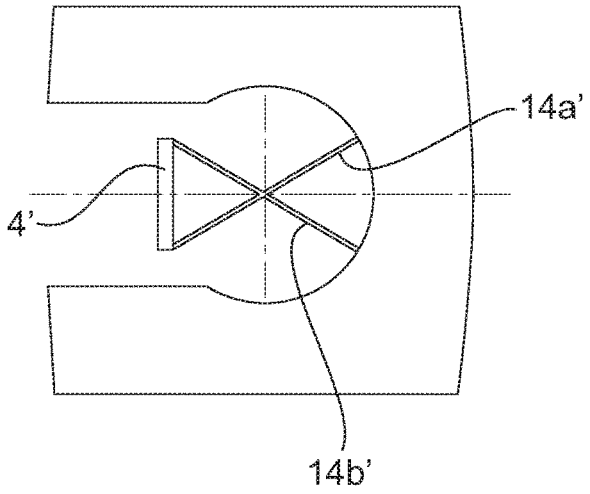
FIGS. 2A and 2B are partial views from above showing in detail the pair of elastic strips which connect one of the balances to the support structure of the resonator in accordance with a second and a third variant respectively of the first embodiment illustrated in FIG. 1.
Figure 2B:
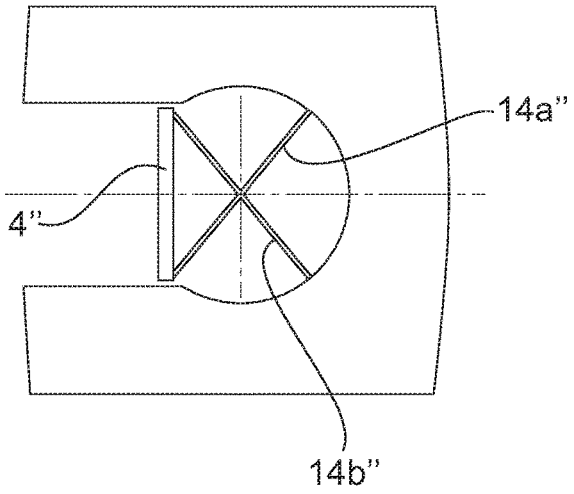

FIGS. 2A and 2B are partial enlarged views showing a second and a third configuration variation of the pair of elastic strips connecting one of the balances to the support structure of the resonator of the invention. By comparing FIGS. 1, 2A and 2B, it will be seen in particular that these figures differ in the value of the angle formed between the two elastic strips coming from one of the bars 4, 4' or 4". In FIG. 1, this angle is substantially equal to 90°, in FIG. 2A, it is substantially less than 90°, and finally in FIG. 2B, it is substantially greater than 90°. The angle at which the strips cross has an effect on the excitability of certain oscillation modes outside the plane of the balances. These higher modes are undesirable for most horological applications of the resonator of the invention. In practice, the angle between the elastic strips will be selected according to the shape of the balances and the desired rigidity in the different planes.

In accordance with the invention, the resonator also comprises a flexible strip 16 which constitutes a strap arranged so as to couple the first and the second balance 6 and 8. The flexible strip is attached to the first and to the second balance, the points, 16*a* and 16*b* respectively, joining the flexible strip to the first and the second balance are located in the same plane, parallel to the plane of oscillation of the two balances and are symmetrical with one another with respect to the central point of the figure (referenced O). Still with reference to FIG. 1, it is possible to see that between the two joining points 16*a* and 16*b*, the shape of the strip 16 has a central symmetry about the central point O. However, it will be understood that this characteristic is present only when the balances 6, 8 are in their inoperative position. As can be verified in the figure, the centre of symmetry O is located half way between the geometrical pivoting axes of the two balances.

FIG. 1 also shows a straight line d which passes via the centre O and via the points 16*a*, 16*b* where the flexible strip 16 joins the two balances 6, 8. In the exemplified embodiments, the straight line d forms an angle α of at least 30°, or even at least 45°, with the plane containing the first and the second geometrical pivoting axis.

In accordance with the invention, the first and the second balance have the same fundamental resonance frequency. By reason of the presence of the strap 16, when one of the balances moves away from its equilibrium position, pulling the strap with it, the other balance is forced to follow the movement, thus moving away from its equilibrium position in the other direction. In particular with reference to FIG. 1, it will be understood that if the first balance 6 pivots clockwise, it exerts traction on the strap 16. The inertia of the strap being very low with respect to that of the balances, the tension to which the strap is subjected affects the second balance 8 at the joining point 16*b*. The second balance is thus subjected to a torque which tends to cause it to pivot anti-clockwise. By thus moving away from their inoperative position, the two balances cause deformation of the X-shaped elastic strips 12*a*, 12*b*, 14*a*, 14*b* which connect them to the support structure (the bars 2 and 4). The deformation of the two pairs of elastic strips produces two return torques which act respectively on the first and the second balance. It can be understood from the preceding statements that the presence of the strap 16 causes synchronisation of the oscillations of the two balances. It may also be noted in passing that the oscillations of the two coupled balances at the resonance frequency are said to be anti-synchronous and not simply synchronous when the oscillations are produced in an anti-symmetrical mode in accordance with what has just been described.

Figure 3:
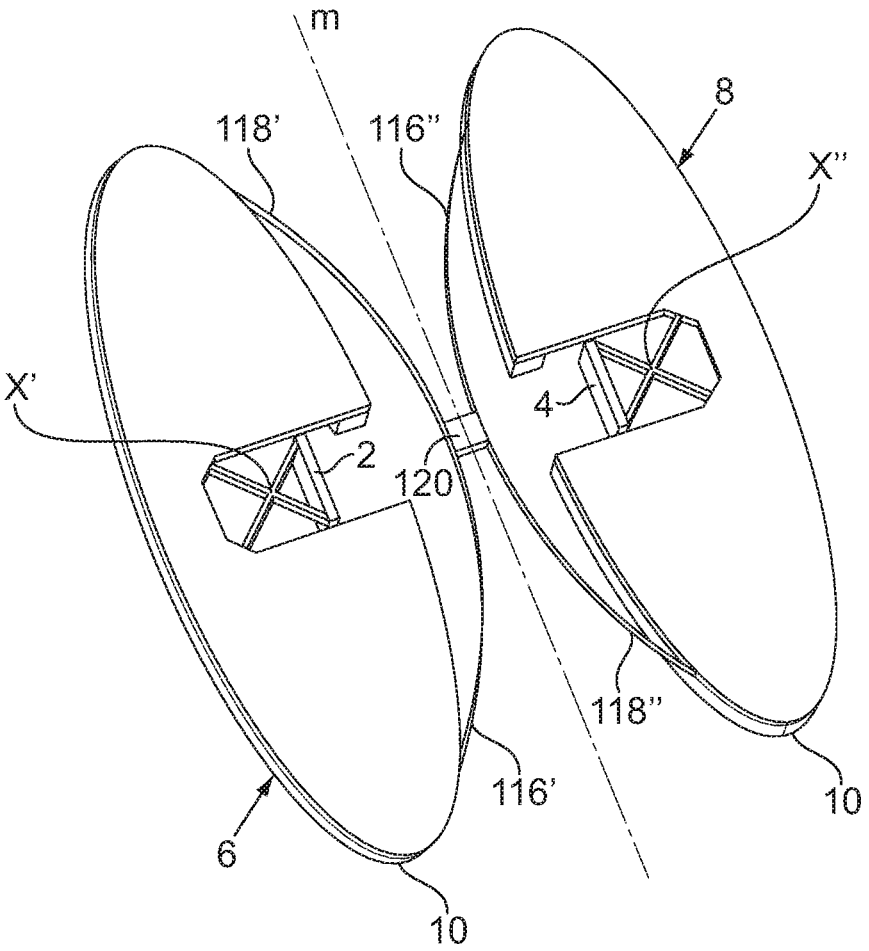
FIGS. 3 and 4 are perspective views of a resonator for a timepiece in accordance with a second particular embodiment of the invention.
Figure 4:
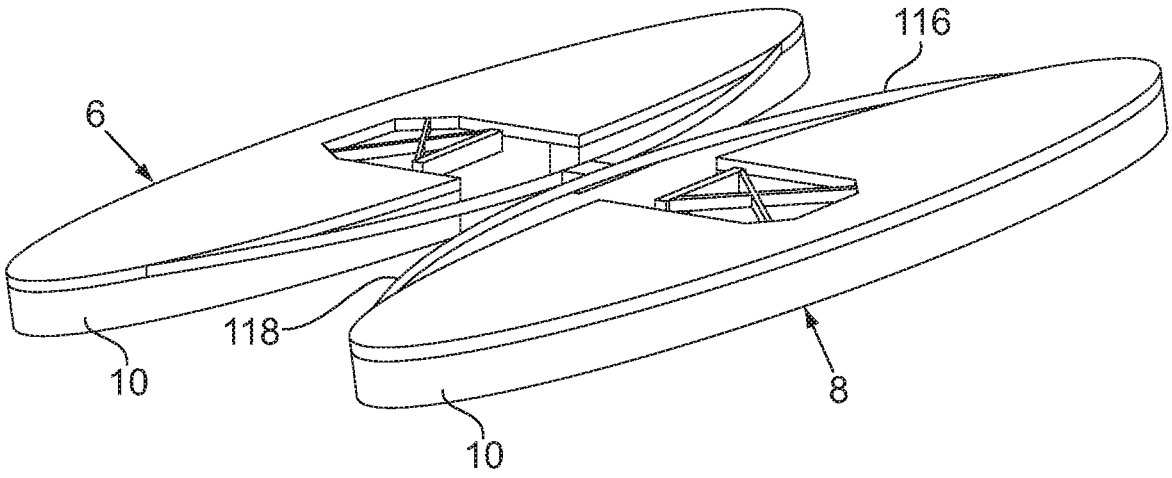

FIGS. 3 and 4 are perspective views of a resonator for a timepiece in accordance with a second particular embodiment of the invention. As can be seen, the resonator illustrated in FIGS. 3 and 4 is very similar to the resonator of FIG. 1. However, in accordance with the second particular embodiment of the invention which is the object of the present example, the resonator comprises a pair of straps 116, 118 attached to each other mid-length by a rigid coupling element 120. The straps 116, 118 are also each attached to the first and to the second balance 6 and 8. In FIG. 3, one half of the strap 116 which extends between the first balance 6 and the coupling element 120 is designated by the reference sign 116' and the other half of the strap 116 which extends between the coupling element and the second balance 8 is designated by the reference sign 116". In a similar way, one half of the strap 118 located between the first balance and the coupling element is designated by the reference sign 118' and the other half by the reference sign 118".

It can be seen in FIG. 3 in particular that, when the balances are in their inoperative position as shown, the straps 116, 118 are symmetrical with respect to each other relative, on the one hand, to the plane containing the first and second geometrical pivoting axes X' and X" and, on the other hand, relative to a parallel intermediate plane equidistant from the two geometrical pivoting axes (the course of the intermediate plane in the plane of the balances is illustrated in FIG. 3 by a broken line designated by the reference sign m).

Again with reference to FIGS. 3 and 4, it can be observed that the pair of straps 116, 118 is principally formed by a first flexible strip attached to the first balance 6 by its two ends, and by a second flexible strip attached to the second balance 8 by its two ends. It can be seen that the two flexible strips are also connected to each other by means of the coupling element 120. The two flexible strips are connected to the coupling element in their middle and it will be understood that in the illustrated construction, the two halves of the first flexible strip respectively constitute the half 116' of the strap 116 and the half 118' of the strap 118. Similarly, the two halves of the second flexible strap respectively constitute the other half 116" of the strap 116 and the other half 118" of the strap 118.

According to the illustrated embodiment, the coupling element 120 is rigid and is arranged to rigidly connect a central portion of the first flexible strip and a central portion of the second flexible strip so that these two central portions are held spaced apart from and parallel with each other. One advantage of the second embodiment just described is its highly symmetrical nature which provides still greater stability in the anti-symmetrical oscillation mode of the resonator. Another advantage is that the effect of the oscillations of the balance at the resonance is a reciprocating movement of the rigid coupling element 120 on a straight trajectory in the plane of symmetry of the resonator (the intermediate plane m already mentioned). The fact of disposing a piece effecting a reciprocating movement on a straight trajectory could in particular be exploited to associate an escapement with the resonator.

In the example illustrated in FIGS. 3 and 4, the rim 10 of each balance 6, 8 is located on the lower side of the balance. Nevertheless, in a variation, it can be located on the upper side or both sides of the balance.

The resonator in accordance with the invention can be formed as one piece e.g. from silicon and/or silicon dioxide, diamond, quartz or metal. To this end, it is possible to use DRIE or LIGA type techniques. The resonator in accordance with the invention can also be obtained by an assembly of pieces.

It will also be understood that various modifications and/or improvements obvious to a person skilled in the art can be made to the embodiments being described herein without departing from the scope of the present invention defined by the accompanying claims. In particular:

- the balances 6, 8 could have an elongate shape other than the shape of an ellipse and could also have a round, square, butterfly wing or other shape. However, the elongate shapes are preferred because they make it possible to distance the points where the straps 16, 116, 118 are attached to the balances 6, 8, which facilitates the adjustment of the elastic coupling between said balances;
- instead of opening facing each other the notches of the balances 6, 8 in which the bars 2, 4 and the elastic strips 12*a*, 12*b*, 14*a*, 14*b* are located could open towards the outside of the balances 6, 8 or could even be closed;
- the orientation of the bars 2, 4 and of the elastic strips 12*a*, 12*b*, 14*a*, 14*b* in the notches could be different from that illustrated. For example, one of the bars 2, 4 or both could be turned by more or less 90° with respect to their position illustrated in FIG. 1. The respective orientations of the bars 2, 4 could be identical or opposite;
- instead of being coplanar and crossing physically as in the illustrated embodiments, the elastic strips 12*a*, 12*b*, 14*a*, 14*b* of each pair could extend in two different parallel planes to form a "Wittrick" type flexible pivot.

With respect to a "Wittrick" type flexible pivot, the X-shaped flexible pivot used in the illustrated embodiments has the disadvantage of greater unwanted movement of the geometrical pivoting axis X', X" during flexing, and of shorter strips in which the concentration of stresses is higher. In contrast, the transverse rigidity of the strips is much greater, which improves the stability of the balances 6, 8 in their plane of rotation and their resistance to shocks outside their plane of rotation;

types of flexible pivot other than an X-shaped pivot or a "Wittrick" pivot could be used to connect each balance 6, 8 to the support structure 2, 4. Furthermore, the number of strips or elastic elements forming each flexible pivot can be greater than two or even be equal to one.

The invention claimed is:

1. Resonator for a timepiece comprising a support structure (2, 4) intended to permit mounting of the resonator in a timepiece, a first and a second balance (6, 8) which are arranged to oscillate in the same plane, at least one first elastic element (12*a*, 12*b*) arranged to connect the first balance (6) to the support structure, at least one second elastic element (14*a*, 14*b*; 14*a*', 14*b*'; 14*a*", 14*b*") arranged to connect the second balance (8) to the support structure, the configuration of the elastic elements determining two parallel geometrical elastic pivoting axes (X', X") for the two balances, and the elastic elements forming resilient means arranged to angularly return each of the balances towards an inoperative position, wherein the resonator further comprises a strap (16; 116, 118) arranged to couple the first and the second balance (6, 8), the strap being attached to the first and to the second balance, the points (16*a*, 16*b*) joining the strap respectively to the first and the second balance are located in the same plane parallel to the plane of oscillation of the balances, and wherein, when the balances are in their inoperative position, first, said joining points are symmetrical with respect to a centre of symmetry (O) located half way between the two geometrical pivoting axes, and second, a radius connecting the centre of symmetry (O) to the point (16*a*, 16*b*) of joining to the first or the second balance, parallel to the plane of oscillation, forms an angle (α) of at least 30° with the plane containing the first and the second geometrical pivoting axis (X', X").

2. Resonator as claimed in claim 1, wherein when the balances are in their inoperative position, the shape of the strap is symmetrical with respect to said centre of symmetry (O).

3. Resonator as claimed in claim 2, wherein when the balances are in their inoperative position, a radius connecting the centre of symmetry (O) to the point (16*a*, 16*b*) of joining to the first or second balance, parallel to the plane of oscillation, forms an angle (α) of at least 45° with the plane containing the first and the second geometrical pivoting axis (X', X").

4. Resonator as claimed in claim 2, further comprising a pair of straps (116, 118) attached to each other mid-length and each attached to the first and to the second balance (6, 8), the pair of straps comprising said strap, and wherein, when the balances (6, 8) are in their inoperative position, the two straps (116, 118) of the pair of straps are symmetrical with respect to each other relative, both to the plane containing the first and the second geometrical pivoting axis (X', X") and, also relative to a parallel intermediate plane (m) equidistant from the two geometrical pivoting axes.

5. Resonator as claimed in claim 2, wherein the first and the second balance (6, 8) have an elongate shape.

6. Resonator as claimed in claim 2, wherein the at least one first elastic element (12*a*, 12*b*) comprises a first pair of elastic strips which are parallel to the plane of pivoting of the balances (6, 8), the strips of the first pair (12*a*, 12*b*) being fixed to the support structure (2, 4) by one end and to the first balance (6) by the other end, and wherein the at least one second elastic element (14*a*, 14*b*; 14*a*', 14*b*'; 14*a*", 14*b*") comprises a second pair of elastic strips which are parallel to the plane of pivoting of the balances (6, 8), the strips of the second pair (14*a*, 14*b*; 14*a*', 14*b*'; 14*a*", 14*b*") being fixed to the support structure (2, 4) by one end and to the second balance (8) by the other end, the two geometrical pivoting axes (X', X") of the two balances each crossing perpendicularly the two elastic strips of one of the pairs.

7. Resonator as claimed in claim 1, wherein when the balances are in their inoperative position, a radius connecting the centre of symmetry (O) to the point (16*a*, 16*b*) of joining to the first or second balance, parallel to the plane of oscillation, forms an angle (α) of at least 45° with the plane containing the first and the second geometrical pivoting axis (X', X").

8. Resonator as claimed in claim 7, further comprising a pair of straps (116, 118) attached to each other mid-length and each attached to the first and to the second balance (6, 8), the pair of straps comprising said strap, and wherein, when the balances (6, 8) are in their inoperative position, the two straps (116, 118) of the pair of straps are symmetrical with respect to each other relative, both to the plane containing the first and the second geometrical pivoting axis (X', X") and, also relative to a parallel intermediate plane (m) equidistant from the two geometrical pivoting axes.

9. Resonator as claimed in claim 7, wherein the first and the second balance (6, 8) have an elongate shape.

10. Resonator as claimed in claim 7, wherein the at least one first elastic element (12*a*, 12*b*) comprises a first pair of elastic strips which are parallel to the plane of pivoting of the balances (6, 8), the strips of the first pair (12*a*, 12*b*) being fixed to the support structure (2, 4) by one end and to the first balance (6) by the other end, and wherein the at least one second elastic element (14*a*, 14*b*; 14*a*', 14*b*'; 14*a*", 14*b*") comprises a second pair of elastic strips which are parallel to the plane of pivoting of the balances (6, 8), the strips of the second pair (14*a*, 14*b*; 14*a*', 14*b*'; 14*a*", 14*b*") being fixed to the support structure (2, 4) by one end and to the second balance (8) by the other end, the two geometrical pivoting axes (X', X") of the two balances each crossing perpendicularly the two elastic strips of one of the pairs.

11. Resonator as claimed in claim 1, further comprising a pair of straps (116, 118) attached to each other mid-length and each attached to the first and to the second balance (6, 8), the pair of straps comprising said strap, and wherein, when the balances (6, 8) are in their inoperative position, the two straps (116, 118) of the pair of straps are symmetrical with respect to each other relative, both to the plane containing the first and the second geometrical pivoting axis (X', X") and, also relative to a parallel intermediate plane (m) equidistant from the two geometrical pivoting axes.

12. Resonator as claimed in claim 1, the pair of straps (116, 118) comprises a first flexible strip attached to the first balance (6) by its two ends, a second flexible strip attached to the second balance (8) by its two ends, and a coupling element (120) arranged to rigidly connect a central portion of the first flexible strip and a central portion of the second flexible strip so that the central portions of the two flexible strips are held spaced apart from and parallel with each other.

13. Resonator as claimed in claim 12, wherein the first and the second balance (6, 8) have an elongate shape.

14. Resonator as claimed in claim 11, wherein the first and the second balance (6, 8) have an elongate shape.

15. Resonator as claimed in claim 1, wherein the first and the second balance (6, 8) have an elongate shape.

16. Resonator as claimed in claim 15, wherein the distance between the geometrical pivoting axis (X', X") of a balance and the edge of the same balance is at least 1.5 times greater in a direction perpendicular to the plane containing the two geometrical pivoting axes (X', X") than in a direction parallel to this plane.

17. Resonator as claimed in claim 15, wherein the distance between the geometrical pivoting axis (X', X") of a balance and the edge of the same balance is at least two times greater in a direction perpendicular to the plane containing the two geometrical pivoting axes (X', X") than in a direction parallel to this plane.

18. Resonator as claimed in claim 1, wherein the at least one first elastic element (12*a*, 12*b*) comprises a first pair of elastic strips which are parallel to the plane of pivoting of the balances (6, 8), the strips of the first pair (12*a*, 12*b*) being fixed to the support structure (2, 4) by one end and to the first balance (6) by the other end, and wherein the at least one second elastic element (14*a*, 14*b*; 14*a*', 14*b*'; 14*a*", 14*b*") comprises a second pair of elastic strips which are parallel to the plane of pivoting of the balances (6, 8), the strips of the second pair (14*a*, 14*b*; 14*a*', 14*b*'; 14*a*", 14*b*") being fixed to the support structure (2, 4) by one end and to the second balance (8) by the other end, the two geometrical pivoting axes (X', X") of the two balances each crossing perpendicularly the two elastic strips of one of the pairs.

19. Resonator as claimed in claim 18, wherein the pair of elastic strips (12*a*, 12*b*, 14*a*, 14*b*) perpendicularly crossing the same geometrical pivoting axis (X', X") are contained in the same plane parallel to the plane of pivoting of the balances so that the two elastic strips of the same pair have an intersection at the place where they cross with the geometrical pivoting axis.

20. Resonator as claimed in claim 19, wherein the two elastic strips (12*a*, 12*b*, 14*a*, 14*b*) of the same pair intersect in their middle.

* * * * *